United States Patent [19]

Kis

[11] Patent Number: 4,756,062

[45] Date of Patent: Jul. 12, 1988

[54] PROCESS OF NEEDLING A FIBROUS WEB FROM BOTH SIDES

[75] Inventor: Ludwig Kis, Goldwörth, Austria

[73] Assignee: Textilmaschinenfabrik, Leonding, Austria

[21] Appl. No.: 66,851

[22] Filed: Jun. 26, 1987

[30] Foreign Application Priority Data

Jul. 17, 1986 [AT] Austria ..... 1945/86

[51] Int. Cl.[4] ..... D04H 18/00

[52] U.S. Cl. ..... 28/107; 28/110; 28/142

[58] Field of Search ..... 28/107, 110, 142

[56] References Cited

U.S. PATENT DOCUMENTS 3,117,359 1/1964 O'Byrne ..... 28/110

3,129,486 4/1964 O'Byrne ..... 28/110

FOREIGN PATENT DOCUMENTS 1240031 5/1967 Fed. Rep. of Germany .

2058716 7/1971 Fed. Rep. of Germany .

376465 5/1964 Switzerland .

*Primary Examiner*—Robert R. Mackey

*Attorney, Agent, or Firm*—Collard, Roe & Galgano

[57] ABSTRACT

An endless fibrous web is to be needled from both sides by needling means for piercing the web in only one direction. For that purpose the web is needled in the form of a twisted endless web, which is known as a Möbius web and has been formed in that the two ends of a finite length of the web have been rotated through 180° relative to each other about the longitudinal axis of the web and have then been joined.

1 Claim, 2 Drawing Sheets

PROCESS OF NEEDLING A FIBROUS WEB FROM BOTH SIDES

BACKGROUND OF THE INVENTION

1. Field of the Invention

This invention relates to a process of needling a fibrous web from both sides, in which the fibrous web is formed into an endless web and the latter is needled by being pierced in only one direction.

2. Description of the Prior Art

Conventional plants for needling an endless fibrous web from both sides by needling means for piercing the web only in one direction either require two needling units for piercing the web in mutually opposite directions or must perform two consecutive operations in which the web is intially needled from one side and is then inverted and needled from the other side by the same needling means. The web must be removed from the web-guiding means before it can be inverted so that such a needling process in which the web is pierced only in one direction involves a high expenditure of time and work.

It is known from Published German Application No. 2,058,716 that a fibrous web can be needled from both sides by a single needling unit if the web which has traveled through the needling unit is reversed around a reversing roller and is then returned to the needling unit. A perforated plate extends between the two superimposed courses of the web and the needling unit is operated to needle the advancing and returning courses of the web at the same time from mutually opposite sides. The needling results in a decrease of the thickness and an increase of the length of the web so that the two courses must be moved at different velocities as they are needled. For this reason an endless fibrous web cannot be needled on both sides by that known needling process. Besides, it is not possible to establish the same needling conditions on both sides of the web and the needling process can be used only for relatively thin webs because the length of the needles is limited owing to strength considerations.

SUMMARY OF THE INVENTION

It is an object of the invention to provide a process which serves to needle an endless fibrous web from both sides while the web is pierced only in one direction but need not be removed from the web-guiding means and inverted.

That object is accomplished in accordance with the invention by twisting opposite ends of a finite length of a fibrous web having a longitudinal axis through 180° about the axis, joining the twisted web ends to form a Mobius web, and needling the Mobius web.

Because the two ends of the fibrous web have been joined after they have been rotated through 180° relative to each other about the longitudinal axis of the web, the web which has been needled from one side by the needling means as far as to the seam between the ends of the web is subsequently needled from the other side so that the fibrous web can be needled from both sides by needling means for piercing the web only in one direction and this can be accomplished in a process in which the web need not be released. It will be understood that two passes of the web through the needling means are required for a needling of the web from both sides. Because the web is pierced from both sides under the same conditions, the same needling conditions are also obtained.

DETAILED DESCRIPTION OF THE PREFERRED EMBODIMENTS

Figure 1:
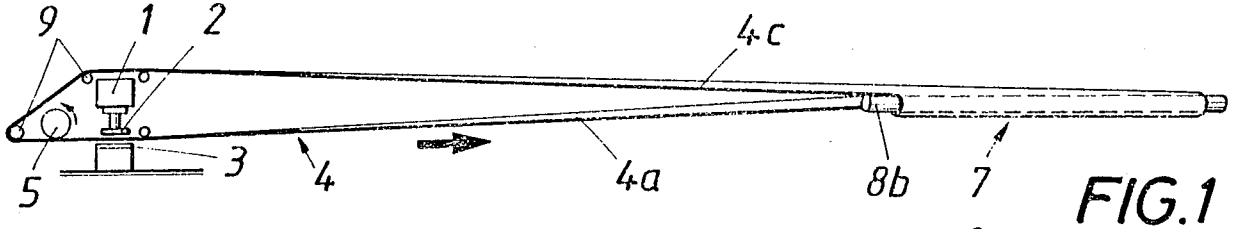
FIG. 1 is a diagrammatic side elevation showing an apparatus by which a twisted endless web can be needled from both sides.

The process in accordance with the invention will be explained more in detail with reference to the drawing.

The illustrated apparatus comprises needling means 1 having a vertically reciprocating needle board 2 and a table 3. The fibrous web 4 extending between the needle board 2 and the needling table 3 can be needled only from above. In the embodiment shown, a non-woven web is unwound from a supply roll 5 and can be needled onto a substrate web.

The fibrous web 4 has been formed into a twisted endless web, known as a Möbius web. For that purposes the two ends of a finite length of the web 4 have been rotated through 180° relative to each other about the longitudinal axis of the web and have then been joined to form a seam 6 shown by a chain-dotted line in FIG. 2. Because the two ends of the web have been rotated relative to each other, the twisted endless web 4 is needled from one side as far as to the seam 6 and is needled from the other side behind the seam 6. As a result, the fibrous web is needled onto the substrate web from both sides by the same needling means 1.

Figure 2:
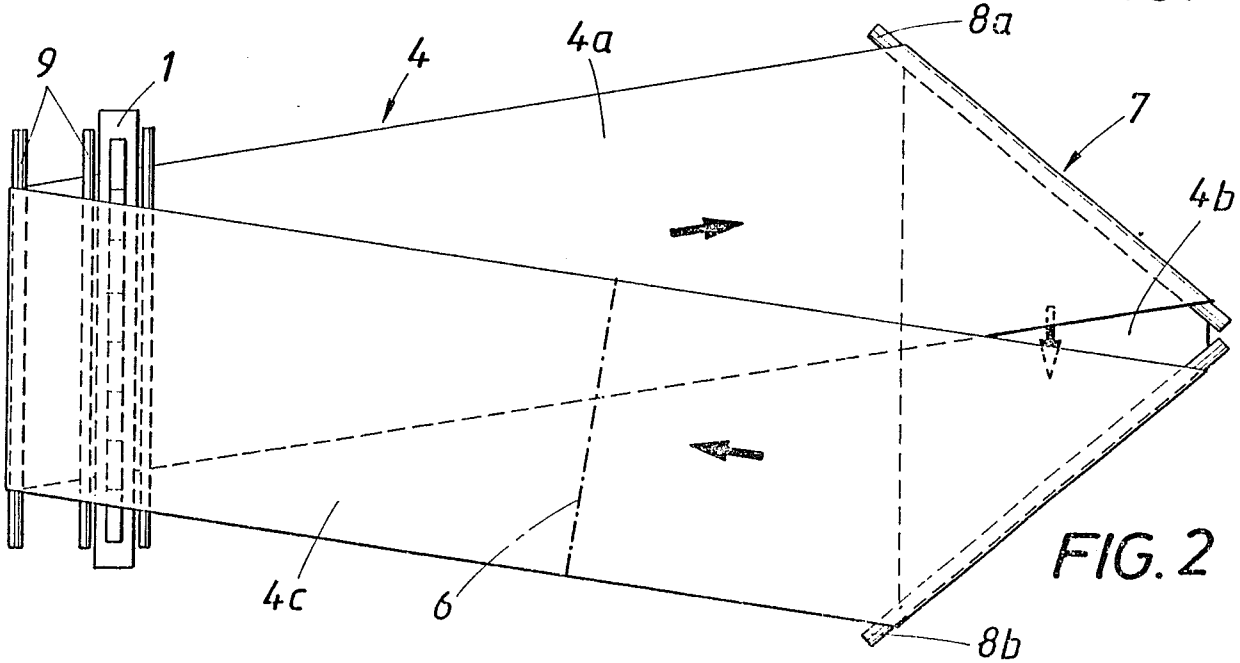
FIG. 2 is a top plan view showing that apparatus.

The fibrous web 4 is guided by reversing means 7 which, in the embodiment shown in FIGS. 1 and 2, comprises two deflecting rollers 8*a*, 8*b*, which are oppositely inclined to the direction of travel of respective courses 4*a* and 4*c* of the web 4. Incoming course 4*a* is deflected to form a course 4*b*, which moves by roller 8*a* to the deflecting roller 8*b* in a direction which is transverse to the direction of the travel of the incoming course 4*a* of the web. The web 4 is deflected by the deflecting roller 8*b* through an angle which is equal and opposite to the angle through which the web 4 is deflected by the deflecting roller 8*a* and then returns as an outgoing course 4*c* from the reversing means 7 toward the needling means 1. Adjacent to the needling means 1, the web is trained around the deflecting rollers 9 in the conventional manner. The outgoing web course 4*c* which leaves the reversing means 7 is symmetrical to the incoming web course 4*a*.

Figures 3, 4:
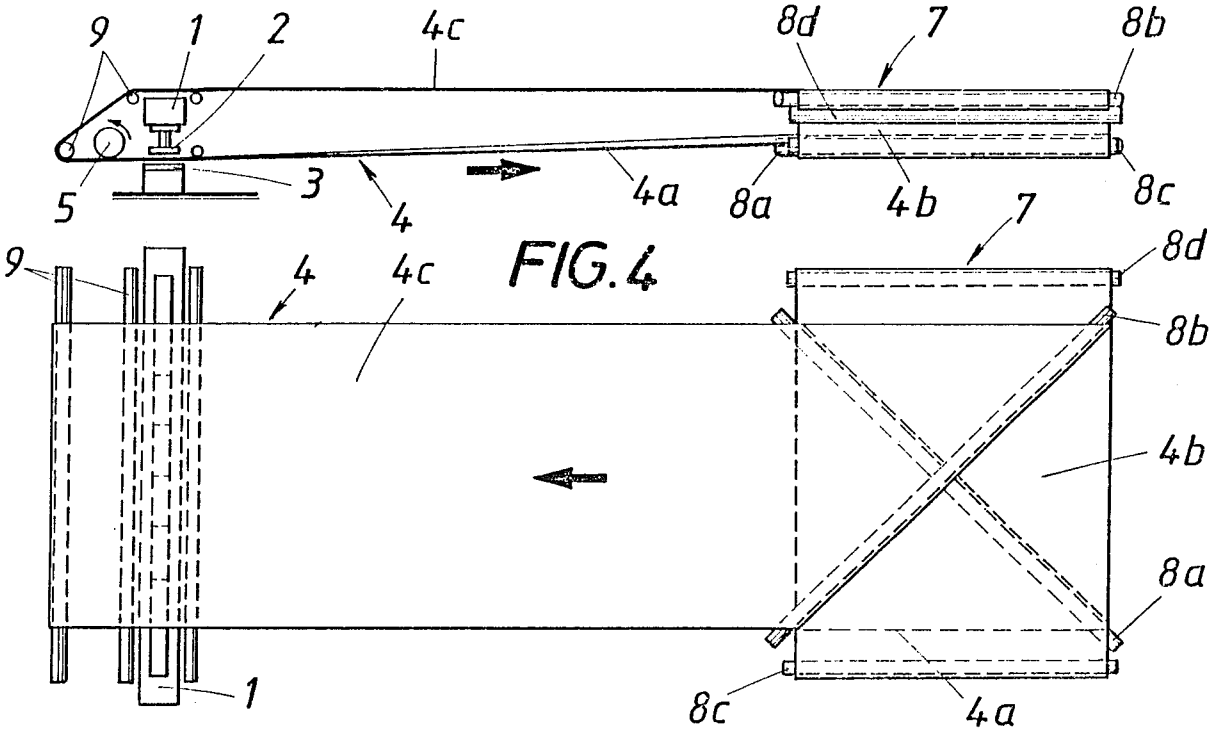
FIG. 3 is a view that is similar to FIG. 1 and shows a modified design.
FIG. 4 is a top plan view showing the apparatus of FIG. 3.

Another embodiment of the reversing means 7 is shown in FIGS. 3 and 4. In that embodiment, the deflecting rollers 8*a* and 8*b* are arranged in two superimposed parallel planes and extend at opposite angles of 45° to the common direction of travel of the incoming and outgoing courses 4*a* and 4*c* of the web 4. Two additional deflecting rollers 8*c* and 8*d*, which are parallel to each other, are provided and extend in the direction of travel of the incoming and outgoing courses 4*a* and 4*c* of the web 4 and guide between them the transversely moving course 4*b* of the web 4. The incoming course 4a of the fibrous web 4 is deflected by the deflecting roller 8*a* toward the deflecting roller 8*c* and moves from the latter as the transverse course 4*b* to the deflecting roller 8*d*. Web 4 moves from the deflecting roller 8*d* to the deflecting roller 8*b* and is deflected by the latter to constitute the outgoing web course 4*c*, which is parallel to the incoming web course 4*a*.

In each of the embodiments shown in FIGS. 1 and 2 and in FIGS. 3 and 4, respectively, the web is guided to form substantially planar courses so that a distortion of the web, which would result in a permanent elongation of the fibrous web 4 at its longitudinal edges, will be avoided.

What is claimed is:

1. A process of needling a finite length of a fibrous web having a longitudinal axis, two longitudinal edges, two opposite ends and two sides, which comprises the steps of (a) twisting the opposite web ends through 180° relative to each other about the longitudinal axis and joining the twisted web ends to form a Mobius web having two substantially planar courses, (b) continuously feeding the planar courses of the Mobius web in endless loop form through a needling station while guiding the web to avoid a distortion thereof resulting in a permanent elongation of the longitudinal web edges, and (c) needling the web from both sides by piercing the same in only one direction.

* * * * *

UNITED STATES PATENT AND TRADEMARK OFFICE

CERTIFICATE OF CORRECTION

PATENT NO. : 4,756,062

DATED : JULY 12, 1988

INVENTOR(S) : LUDWIG KIS

It is certified that error appears in the above-identified patent and that said Letters Patent are hereby corrected as shown below:

Cover page, item [73] , insert Assignee's complete name and address:--Textilmaschinenfabrik Dr. Ernst Fehrer AG, Leonding, Austria.--

Signed and Sealed this

Twentieth Day of December, 1988

*Attest:*

DONALD J. QUIGG

*Attesting Officer*

*Commissioner of Patents and Trademarks*